US011794244B2

(12) United States Patent
Saito et al.

(10) Patent No.: US 11,794,244 B2
(45) Date of Patent: Oct. 24, 2023

(54) METHOD FOR MANUFACTURING DUST CORE AND RAW MATERIAL POWDER FOR DUST CORE

(71) Applicants: Sumitomo Electric Industries, Ltd., Osaka (JP); SUMITOMO ELECTRIC SINTERED ALLOY, LTD., Takahashi (JP)

(72) Inventors: Tatsuya Saito, Osaka (JP); Asako Watanabe, Osaka (JP); Tomoyuki Ueno, Osaka (JP); Hijiri Tsuruta, Takahashi (JP)

(73) Assignees: Sumitomo Electric Industries, Ltd., Osaka (JP); SUMITOMO ELECTRIC SINTERED ALLOY, LTD., Takahashi (JP)

( * ) Notice: Subject to any disclaimer, the term of this patent is extended or adjusted under 35 U.S.C. 154(b) by 161 days.

(21) Appl. No.: 16/643,666

(22) PCT Filed: Aug. 10, 2018

(86) PCT No.: PCT/JP2018/030124
§ 371 (c)(1),
(2) Date: Mar. 2, 2020

(87) PCT Pub. No.: WO2019/044467
PCT Pub. Date: Mar. 7, 2019

(65) Prior Publication Data

US 2020/0269316 A1 Aug. 27, 2020

(30) Foreign Application Priority Data

Sep. 4, 2017 (JP) ..... 2017-169247

(51) Int. Cl.

| | |
|---|---|
| ***B22F 3/02*** | (2006.01) |
| ***H01F 1/24*** | (2006.01) |
| ***B22F 3/24*** | (2006.01) |
| ***H01F 27/255*** | (2006.01) |
| ***B22F 1/105*** | (2022.01) |
| ***B22F 1/16*** | (2022.01) |
| *C22C 38/02* | (2006.01) |
| *C22C 38/06* | (2006.01) |

(52) U.S. Cl.
CPC ..... *B22F 1/105* (2022.01); *B22F 1/16* (2022.01); *B22F 3/02* (2013.01); *B22F 3/24* (2013.01); *H01F 1/24* (2013.01); *H01F 27/255* (2013.01); *B22F 2003/248* (2013.01); *B22F 2201/03* (2013.01); *B22F 2301/35* (2013.01); *C22C 38/02* (2013.01); *C22C 38/06* (2013.01)

(58) Field of Classification Search
None
See application file for complete search history.

(56) References Cited

U.S. PATENT DOCUMENTS

| | | | | |
|---|---|---|---|---|
| 2001/0016977 | A1* | 8/2001 | Moro | B22F 7/08 29/606 |
| 2003/0077448 | A1 | 4/2003 | Ueta et al. | |
| 2010/0188179 | A1* | 7/2010 | Mitani | H01F 41/0246 335/297 |
| 2012/0119134 | A1 | 5/2012 | Muramatsu et al. | |
| 2012/0154083 | A1* | 6/2012 | Ohwaki | B22F 1/16 335/297 |
| 2013/0181802 | A1 | 7/2013 | Watanabe et al. | |
| 2014/0138569 | A1* | 5/2014 | Otsuka | H01F 27/255 252/62.54 |
| 2015/0243420 | A1 | 8/2015 | Miyamura et al. | |

FOREIGN PATENT DOCUMENTS

| | | | |
|---|---|---|---|
| JP | S53-058411 | A | 5/1978 |
| JP | 2003-303711 | A | 10/2003 |
| JP | 2005303006 | A * | 10/2005 |
| JP | 2011-029302 | A | 2/2011 |
| JP | 2012-107330 | A | 6/2012 |
| JP | 2012-138494 | A | 7/2012 |
| JP | 2014-090152 | A | 5/2014 |

OTHER PUBLICATIONS

Machine translation of JP2005-303006A. (Year: 2005).*
Lu Cai, "Metallic Magnetic Powder", Beijing Science Education Press, Jul. 31, 1961, pp. 60-61.
CN Office Action dated May 25, 2022 in Chinese Application No. 201880057009.2 (with attached machine English-language translation).

* cited by examiner

*Primary Examiner* — Xiaowei Su
(74) *Attorney, Agent, or Firm* — Faegre Drinker Biddle & Reath LLP

(57) ABSTRACT

A method for manufacturing a dust core, including: a step of preparing a raw material powder including a coated pure iron powder composed of a plurality of pure iron particles each having an insulating coating layer, a coated iron alloy powder composed of a plurality of iron alloy particles each having an insulating coating layer, and a metal soap;
a step of manufacturing a molded article by performing a compression molding of the raw material powder filled in a mold; and a step of performing a heat treatment of the molded article to eliminate distortions in the coated pure iron powder and the coated iron alloy powder, wherein a difference Tm−Td between a melting point Tm of the metal soap and a temperature Td of the mold in the step of manufacturing the molded article is greater than or equal to 90° C.

13 Claims, No Drawings

METHOD FOR MANUFACTURING DUST CORE AND RAW MATERIAL POWDER FOR DUST CORE

TECHNICAL FILED

The present disclosure relates to a method for manufacturing a dust core and a raw material powder for a dust core.

This application claims priority from prior Japanese Patent Application No. 2017-169247, filed on Sep. 4, 2017, the entire contents of which are incorporated herein by reference.

BACKGROUND ART

As a method for manufacturing a dust core to be provided in various electromagnetic components, a method for manufacturing a dust core disclosed in Patent Literature 1 is known. The method for manufacturing a dust core disclosed in Patent Literature 1 includes, for example, a preparation step, a coating step, a mixing step, a pressurizing step and a heat treatment step as mentioned below.

In the preparation step, soft magnetic particles are prepared.

In the coating step, each of the surfaces of the soft magnetic particles is coated with an insulating layer.

In the mixing step, a coated soft magnetic powder composed of a plurality of soft magnetic particles each coated with the insulating layer is mixed with a resin powder for molding use (a lubricant) to form a mixed powder.

In the pressurizing step, the mixed powder is pressurized in a molding mold to manufacture a molded article.

In the heat treatment step, the molded article is subjected to a heat treatment to eliminate distortions that are introduced into the soft magnetic particles during the pressurizing step.

CITATION LIST

Patent Literature

PTL1: Japanese Patent Laying-Open No. 2012-107330

SUMMARY OF INVENTION

The method for manufacturing a dust core according to the present disclosure includes:

- a step of preparing a raw material powder including a coated pure iron powder composed of a plurality of pure iron particles each having an insulating coating layer, a coated iron alloy powder composed of a plurality of iron alloy particles each having an insulating coating layer, and a metal soap;
- a step of manufacturing a molded article by performing a compression molding of the raw material powder filled in a mold; and
- a step of performing a heat treatment of the molded article to eliminate distortions in the coated pure iron powder and the coated iron alloy powder,
- wherein a difference Tm−Td between a melting point Tm of the metal soap and a temperature Td of the mold in the step of manufacturing the molded article is greater than or equal to 90° C.

The raw material powder for a dust core according to the present disclosure includes:

- a coated pure iron powder composed of a plurality of pure iron particles each having an insulating coating layer;

- a coated iron alloy powder composed of a plurality of iron alloy particles each having an insulating coating layer; and
- a metal soap which has a melting point Tm of higher than or equal to 200° C.,
- wherein a Vickers hardness of the iron alloy particles is greater than or equal to 200 HV,
- a content of the coated iron alloy powder is greater than or equal to 15% by mass and less than or equal to 40% by mass, and
- a content of the metal soap is greater than or equal to 0.02% by mass and less than or equal to 0.80% by mass.

DETAILED DESCRIPTION

Problem to be Solved by the Present Disclosure

It has been demanded to further reduce the core loss of a dust core. In particular, it has been demanded to reduce the core loss (iron loss) of a dust core by reducing the eddy current loss of the dust core.

In these situations, one object is to provide a dust core manufacture method whereby it becomes possible to manufacture a dust core having a low core loss.

Another object is to provide a raw material powder for a dust core, which makes it possible to construct a dust core having a low core loss.

Advantageous Effect of the Present Disclosure

The above-mentioned dust core manufacture method enables the production of a dust core having a small core loss.

The above-mentioned raw material powder for a duct core makes it possible to construct a dust core having a small core loss.

Description of Embodiments of the Present Disclosure

As the soft magnetic particles for a dust core, pure iron particles or iron alloy particles are generally used depending on the intended use of the dust core and the properties to be required for the dust core. Pure iron particles are more likely to be deformed and become more highly dense compared with an iron alloy. In contrast, iron alloy particles have a lower magnetic coercive force, higher electric resistivity, and a smaller eddy current loss compared with pure iron. The present inventors have considered to manufacture a dust core having both of the properties of pure iron particles and the properties of iron alloy particles by combining the pure iron particles and the iron alloy particles. Then, the present inventors have studied on the manufacture of a dust core having a high density, a small magnetic coercive force and a small eddy current loss (iron loss). However, it is found that the eddy current loss of the dust core is often increased. As the causes of this phenomenon, the following factors can be considered. Pure iron particles are softer and therefore are more likely to be deformed compared with an iron alloy powder. Therefore, the pure iron particles are deformed excessively by the iron alloy particles upon compression molding. Due to the excessive deformation of the pure iron particles, the insulating layers that cover the surfaces of the pure iron particles are damaged to reduce the insulation among the particles. In these situations, the present inventors have made extensive studies on a manufacture method whereby it becomes possible to reduce an eddy current loss (iron loss) even when both of pure iron particles and iron alloy particles are contained. As a result, it is found that an eddy current loss can be reduced and consequently an iron loss can be reduced when the melting point Tm of a metal soap that is used as a lubricant and the temperature Td of a mold to be used in compression molding satisfy a specified relationship. The present disclosure is achieved on the basis of this finding. Firstly, embodiments of the present disclosure will be described.

(1) The method for manufacturing a dust core according to one embodiment of the present disclosure includes:

a step of preparing a raw material powder including a coated pure iron powder composed of a plurality of pure iron particles each having an insulating coating layer, a coated iron alloy powder composed of a plurality of iron alloy particles each having an insulating coating layer, and a metal soap;

a step of manufacturing a molded article by performing a compression molding of the raw material powder filled in a mold; and a step of performing a heat treatment of the molded article to eliminate distortions in the coated pure iron powder and the coated iron alloy powder, wherein a difference Tm−Td between a melting point Tm of the metal soap and a temperature Td of the mold in the step of manufacturing the molded article is greater than or equal to 90° C.

According to the above-mentioned configuration, it becomes possible to manufacture a dust core having a small core loss. This is presumed to be because the damage of the insulating coating layers in the coated pure iron powder can be prevented in the molding step. As a result, the insulation among the particles is increased to facilitate the reduction in an eddy current loss. Consequently, the reduction in iron loss is facilitated.

As the reasons why the damage of the insulating coating layers in the coated pure iron powder can be prevented, the following reasons can be considered. By setting the difference Tm−Td to greater than or equal to 90° C., the raw material powder can be compression-molded while preventing the melting of the metal soap during the molding step. In other words, the raw material powder can be compression-molded under such a condition that the metal soap can keep a certain level of hardness. Due to the action of the metal soap, it becomes easy to reduce the stress applied to the pure iron particles from the iron alloy particles while increasing lubricity during the compression molding. As a result, the damage of the insulating coating layers in the coated pure iron powder can be prevented even if the iron alloy particles deform the pure iron particles upon the compression molding.

(2) In one embodiment of the method for manufacturing a dust core, a melting point Tm of the metal soap is higher than or equal to 200° C.

According to the above-mentioned configuration, the prevention of the damage of the insulating coating layers in the coated pure iron powder can be facilitated. Furthermore, the density of the molded article can be increased. As a result, the density of the dust core can be increased. Because the melting point Tm of the metal soap is high, the difference from the temperature Td of the mold can be increased. Therefore, it becomes possible to impart a certain level of hardness to the metal soap during the compression molding. Consequently, the effect to prevent the damage of the insulating coating layers in the coated pure iron powder can be increased. Furthermore, due to the high melting point Tm of the metal soap, the raw material powder can be compression-molded at a higher temperature Td of the mold. As a result, it becomes possible to facilitate the deformation of the coated pure iron powder and the iron alloy powder. Consequently, it becomes possible to facilitate the increase in the density of the molded article.

(3) In one embodiment of the method for producing a dust core, a temperature Td of the mold is lower than or equal to 130° C.

According to the above-mentioned configuration, the temperature Td of the mold is not too high excessively, and it becomes possible to facilitate the prevention of the excessive deformation of the coated pure iron powder and the iron alloy powder. As a result, it becomes possible to facilitate the prevention of the damage of the insulating coating layers in the coated pure iron powder by the metal soap.

(4) In one embodiment of the method for manufacturing a dust core, a Vickers hardness of the iron alloy particles is greater than or equal to 200 HV.

According to the above-mentioned configuration, the prevention of the damage of the insulating coating layers in the coated pure iron powder can be facilitated. The damage of the insulating coating layers in the coated pure iron powder may occur more easily with the increase in the Vickers hardness of the iron alloy particles. However, when the difference (Tm−Td) between the melting point Tm of the metal soap and the temperature Td of the mold falls within the above-mentioned range, the damage of the insulating coating layers in the coated pure iron powder can be prevented even if the Vickers hardness is high.

(5) In one embodiment of the method for manufacturing a dust core, the Vickers hardness of the iron alloy particles is greater than or equal to 200 HV, the melting point Tm of the metal soap is higher than or equal to 200° C., and the temperature Td of the mold is lower than or equal to 130° C.

According to the above-mentioned configuration, the prevention of the damage of the insulating coating layers in the coated pure iron powder can be facilitated. Furthermore, the density of the dust core can also be increased.

(6) In one embodiment of the method for manufacturing a dust core, a content of the coated iron alloy powder in the raw material powder is greater than or equal to 15% by mass and less than or equal to 40% by mass.

When the content of the coated iron alloy powder is greater than or equal to 15% by mass, the content of the iron alloy component in the molded article can be increased. The electric resistivity of an iron alloy is high. Therefore, the reduction in an eddy current loss can be facilitated. Furthermore, when the content of the iron alloy component is increased, the reduction in the magnetic coercive force of the dust core can be facilitated. When the content of the coated iron alloy powder is less or equal to 40% by mass, the content of the iron alloy component in the molded article is not excessively too high. Therefore, the prevention of the excessive deformation of the coated pure iron powder that is normally deformed easily can be facilitated. Consequently, the prevention of the damage of the insulating coating layers in the coated pure iron powder can be facilitated. Furthermore, the content of the pure iron component that is normally deformed easily can be increased. As a result, the density of the molded article can be increased. Consequently, the density of the dust core can be increased.

(7) In one embodiment of the method for manufacturing a dust core, a content of the metal soap in the raw material powder is greater than or equal to 0.02% by mass and less than or equal to 0.80% by mass.

When the content of the metal soap is greater than or equal to 0.02% by mass, it becomes easy to achieve the effect to improve the lubricity satisfactorily. As a result, the effect to reduce the stress acting on the pure iron particles can become high. Consequently, the prevention of the damage of the insulating coating layers in the coated pure iron powder can be facilitated. When the content of the metal soap is less than or equal to 0.80% by mass, the content of the metal soap is not excessively too large. Therefore, it becomes possible to prevent the decrease in the content of the metal component in the molded article.

(8) In one embodiment of the method for manufacturing a dust core, each of the iron alloy particles contains at least one additive element selected from Si and Al.

According to the above-mentioned configuration, it becomes easy to manufacture a dust core having a small core loss. This is because iron alloy particles containing the additive element have a high electric resistivity and therefore can facilitate the reduction in the eddy current loss. This is also because the iron alloy particles have a small hysteresis loss.

(9) In one embodiment of the method for manufacturing a dust core, a thickness of each of the insulating coating layer in the coated pure iron powder and the insulating coating layer in the coated iron alloy powder is greater than or equal to 30 nm and less than or equal to 300 nm.

When the thickness of each of the insulating coating layers is greater than or equal to 30 nm, the improvement in the insulation between the particles can be facilitated. When the thickness of each of the insulating coating layers is less than or equal to 120 nm, it becomes easy to manufacture a dust core having a high density.

(10) In one embodiment of the method for manufacturing a dust core, the step of carrying out the heat treatment of the molded article is carried out under an atmosphere having an oxygen concentration of greater than 0 ppm by volume and less than or equal to 10000 ppm by volume at a temperature of higher than or equal to 400° C. and lower than or equal to 1000° C. and with a retention time of longer than or equal to 10 minutes and shorter than or equal to 60 minutes.

According to the above-mentioned configuration, it becomes possible to eliminate distortions in the coated pure iron powder and the iron alloy powder satisfactorily. As a result, the hysteresis loss can be reduced. Accordingly, it becomes easy to manufacture a dust core having a small core loss.

(11) A raw material powder for a dust core according to one embodiment of the present disclosure includes:

- a coated pure iron powder composed of a plurality of pure iron particles each having an insulating coating layer;
- a coated iron alloy powder composed of a plurality of iron alloy particles each having an insulating coating layer; and
- a metal soap which has a melting point Tm of higher than or equal to 200° C.,
- wherein a Vickers hardness of the iron alloy particles is greater than or equal to 200 HV,
- a content of the coated iron alloy powder is greater than or equal to 15% by mass and less than or equal to 40% by mass, and
- a content of the metal soap is greater than or equal to 0.02% by mass and less than or equal to 0.80% by mass.

According to the above-mentioned configuration, it becomes possible to construct a dust core having a reduced core loss.

Detail Description of Embodiment of the Present Disclosure

The details of the method for manufacturing a dust core according to the embodiment of the present disclosure will be described.

[Method for Manufacturing Dust Core]

The method for manufacturing a dust core according to the embodiment includes: a step of preparing a raw material powder (i.e., a raw material powder for a dust core) (wherein the step is also referred to as a "raw material preparation step", hereinafter); a step of manufacturing a molded article (wherein the step is also referred to as a "molding step", hereinafter); and a step of performing a heat treatment of the molded article (wherein the step is also referred to as a "heat treatment step", hereinafter). In the preparation step, a raw material powder including a coated pure iron powder, a coated iron alloy powder and a metal soap is prepared. In the molding step, the raw material powder filled in a mold is subjected to compression molding to manufacture a molded article. In the heat treatment step, distortions introduced into the coated pure iron powder and the iron alloy powder which constitute the molded article are eliminated. One characteristic feature of the method for manufacturing a dust core is a matter that the difference (Tm−Td) between the melting point Tm of the metal soap and the temperature Td of the mold in the molding step falls within a specified range. Namely, the type of the metal soap is selected and the temperature Td of the mold is adjusted so as to satisfy the above-mentioned specified range. Hereinbelow, the details about the steps will be described in turn.

[Preparation Step]

In the preparation step, a raw material powder including a coated pure iron powder, a coated iron alloy powder and a metal soap is prepared.

[Raw Material Powder]

<Coated Pure Iron Powder, Coated Iron Alloy Powder>

The coated pure iron powder contains: a plurality of pure iron particles (i.e., a pure iron powder) composed of pure iron (purity: greater than or equal to 99% by mass; with the remainder made up by unavoidable impurities); and insulating coating layers respectively covering the outer peripheries of the pure iron particles. The coated pure iron powder is composed of a plurality of pure iron particles each having an insulating coating layer. The coated iron alloy powder contains: a plurality of iron alloy particles (i.e., an iron alloy powder) composed of an iron alloy; and insulating coating layers respectively covering the outer peripheries of the iron alloy particles. The coated iron alloy powder is composed of a plurality of iron alloy particles each having an insulating coating layer. The wording "composed of pure iron particles" means that "any component other than pure iron particles is not contained". The wording "composed of iron alloy particles" means that "any component other than iron alloy particles is not contained". The preparation of the coated pure iron powder and the coated iron alloy powder is carried out by, for example, preparing a plurality of pure iron particles and a plurality of iron alloy particles, and then forming an insulating coating layer on each of the outer peripheries of the pure iron particles and each of the outer peripheries of the iron alloy particles.

Pure Iron Particles

The pure iron particles in the coated pure iron powder is composed of pure iron (purity: greater than or equal to 99% by mass; with the remainder made up by unavoidable impurities). Therefore, the pure iron particles are softer and can be deformed more easily compared with the iron alloy particles.

Average Particle Diameter

The average particle diameter of the pure iron particles is preferably greater than or equal to 50 μm and less than or equal to 400 μm. When the average particle diameter of the pure iron particles is greater than or equal to 50 μm, it becomes easy to manufacture a dust core having a high density. When the average particle diameter of the pure iron particles is less than or equal to 400 μm, the eddy current loss of the pure iron particles themselves is more likely to be reduced. Therefore, it becomes easy to manufacture a dust core having a small core loss. The average particle diameter of the pure iron particles is more preferably greater than or equal to 50 μm and less than or equal to 250 μm, particularly preferably greater than or equal to 50 μm and less than or equal to 200 μm. The average particle diameter refers to a particle diameter (D50) at which the cumulative volume in a volume particle size distribution as measured by a laser diffraction particle size distribution measurement device becomes 50%. This can apply to the below-mentioned average particle diameter of the iron alloy particles.

Iron Alloy Particles

The iron alloy particles in the coated iron alloy powder contain an additive element, and therefore has a lower purity compared with pure iron. Therefore, the iron alloy particles are harder and are less likely to be deformed compared with the pure iron particles. The iron alloy particles may have a chemical composition composed of a single component or a chemical composition composed of a plurality of components. Namely, all of the iron alloy particles may have the same chemical composition, or iron alloy particles having different chemical compositions from one another may be contained.

Chemical Composition

The additive element in the iron alloy is preferably at least one element selected from Si (silicon) and Al (aluminum). The iron alloy containing the additive element has a high electric resistivity and therefore is likely to be reduced with respect to the eddy current loss thereof. Furthermore, the iron alloy has a small hysteresis loss. Therefore, it becomes easy to manufacture a dust core having a small core loss. The content of the additive element is, for example, greater than or equal to 1.0% by mass and less than or equal to 30.0% by mass. The remainder in the iron alloy is composed of Fe and unavoidable impurities.

Examples of the iron alloy include a Fe—Si—Al-based alloy, a Fe—Si-based alloy and a Fe—Al-based alloy. In the Fe—Si—Al-based alloy, the content of Si is, for example, greater than or equal to 1.0% by mass and less than or equal to 15.0% by mass, more preferably greater than or equal to 3.0% by mass and less than or equal to 12.0% by mass, and the content of Al is, for example, greater than or equal to 1.0% by mass and less than or equal to 10.0% by mass, more preferably greater than or equal to 2.0% by mass and less than or equal to 8.0% by mass. In the Fe—Si-based alloy, the content of Si is, for example, greater than or equal to 1.0% by mass and less than or equal to 18.0% by mass, more preferably greater than or equal to 2.0% by mass and less than or equal to 10.0% by mass. In the Fe—Al-based alloy, the content of Al is, for example, greater than or equal to 1.0% by mass and less than or equal to 20.0 by mass, more preferably greater than or equal to 2.0% by mass and less than or equal to 15.0% by mass. The analysis of the chemical composition of the iron alloy can be carried out by energy dispersive X-ray spectroscopy (EDX) with a TEM.

Vickers Hardness

The Vickers hardness of the iron alloy particles can be greater than or equal to 200 HV. When the Vickers hardness of the iron alloy particles is greater than or equal to 200 HV, it becomes easy to prevent the occurrence of the damage of the insulating coating layers in the coated pure iron powder. The iron alloy particles are harder than the pure iron particles. The pure iron particles are more likely to be deformed than the iron alloy particles. Therefore, in the molding step, the pure iron particles are deformed by the iron alloy particles. The excessive deformation of the coated pure iron powder in the molding step may occur more easily with the increase in the Vickers hardness of the iron alloy particles. If the deformation of the coated pure iron powder is too large, the insulating coating layers in the coated pure iron powder may be damaged. However, as mentioned below in detail, when the requirement that the difference (Tm−Td) between the melting point Tm of the metal soap contained in the raw material powder and the temperature Td of the mold in the molding step falls within a specified range is satisfied, the damage of the insulating coating layers in the coated pure iron powder can be prevented even when iron alloy particles having a high Vickers hardness are used. The Vickers hardness of the iron alloy particles is more preferably greater than or equal to 250 HV, particularly preferably greater than or equal to 300 HV. The upper limit of the Vickers hardness of the iron alloy particles is, for example, less than or equal to 1000 HV. The Vickers hardness is a value determined by embedding the iron alloy powder in a resin, then grinding the resin so as to expose the iron alloy particles on the resin, then measuring the hardness of the exposed iron alloy particles, and then averaging the measured values (n=10).

Average Particle Diameter

Like the average particle diameter of the pure iron particles, the average particle diameter of the iron alloy particles is preferably greater than or equal to 50 μm and less than or equal to 400 μm, more preferably greater than or equal to 50 μm and less than or equal to 250 μm, particularly preferably greater than or equal to 50 μm and less than or equal to 200 μm. The average particle diameter of the pure iron particles and the average particle diameter of the iron alloy particles may be the same as each other, or may be different from each other as long as the above-mentioned range can be satisfied. In the case where the average particle diameters of both of the particles are different from each other, the relation between these average particle diameters may be "(pure iron particles)<(iron alloy particles)" or "(pure iron particles)>(iron alloy particles)". When the relation between these average particle diameters is "(pure iron particles)<(iron alloy particles)" and the relation between the contents is "(pure iron particles)>(iron alloy particles)", It becomes easy to increase the density of the molded article. This is because, when the pure iron particles having a larger content and capable of being deformed more easily are smaller and the iron alloy particles capable of deforming the pure iron particles are larger, it becomes possible to place the pure iron particles between the iron alloy particles satisfactorily and therefore the pure iron particles can be deformed satisfactorily by the iron alloy particles. On the contrary, when the relation between these average particle diameters is "(pure iron particles">(iron alloy particles)" and the relation between the contents is "(pure iron particles)>(iron alloy particles)", It becomes easy to reduce the eddy current loss. This is because, when the pure iron particles having a larger content and capable of being deformed more easily are larger and the iron alloy particles capable of deforming the pure iron particles are smaller, it becomes easy to prevent the excessive deformation of the pure iron particles.

The preparation of the pure iron particles and the iron alloy particles may be carried out by producing these particles by an atomization method such as a gas atomization method and a water atomization method, or a commercially available pure iron powder and a commercially available iron alloy powder may be purchased.

Insulating Coating Layer

Each of the insulating coating layers in the coated pure iron powder and the coated iron alloy powder can increase the insulation between the pure iron particles, the insulation between the iron alloy particles and the insulation between the pure iron particle and the iron alloy particle. Each of the insulating coating layers is formed immediately on the surface of each of the pure iron particles and the iron alloy particles. The materials for the insulating coating layers for the coated pure iron powder and the material for the insulating coating layers for the coated iron alloy powder may be the same as each other or different from each other.

Material

An example of the material for the insulating coating layer is a phosphoric acid compound containing a phosphate salt as the main component. A specific example of the phosphate salt is iron phosphate. The chemical composition of the insulating coating layer preferably has, for example, a phosphorus content of greater than or equal to 10 at. % and less than or equal to 15 at. %, an iron content of greater than or equal to 15 at. % and less than or equal to 20 at. %, and a remainder made up by oxygen and unavoidable impurities. By using an insulating coating layer satisfying the above-mentioned chemical composition, it becomes easy to manufacture a dust core having a small core loss. The content of iron in the insulating coating layer can be more preferably greater than or equal to 16 at. % and less than or equal to 19 at. %, particularly preferably greater than or equal to 17 at. % and less than or equal to 19 at. %. The analysis of the chemical composition of the insulating coating layer can be carried out by EDX with a TEM.

Thickness

The thickness of the insulating coating layer is preferably greater than or equal to 30 nm and less than or equal to 300 nm. When the thickness of the insulating coating layers is greater than or equal to 30 nm, it becomes easy to increase the insulation between the particles. When the thickness of the insulating coating layers is less than or equal to 300 nm, it becomes easy to manufacture a dust core having a high density. The thickness of the insulating coating layer is more preferably greater than or equal to 40 nm and less than or equal to 250 nm, particularly preferably greater than or equal to 50 nm and less than or equal to 200 nm. The measurement of the thickness of the insulating coating layer can be carried out in the following manner. The coated pure iron powder and the coated iron alloy powder are embedded in a resin. A cross section of each of the coated pure iron powder and the coated iron alloy powder in the insulating coating layer in the resultant embedded product is observed with a TEM. The observation image is analyzed. Alternatively, the measurement of the thickness of the insulating coating layer can also be carried out in the following manner. The raw material powder is molded under the below-mentioned molding conditions. A cross section of a dust core that is heat-treated under the below-mentioned heating treatment conditions is observed with a TEM. The observation image is analyzed. This is because the thicknesses of the insulating coating layer in the coated pure iron powder having a powdery form and the insulating coating layer in the coated iron alloy powder having a powdery form before the compression molding are substantially the same as those of the insulating coating layer in the coated pure iron powder and the insulating coating layer in the coated iron allow powder in the dust core after the compression molding. In either one of these methods, the number of observation fields are greater than or equal to 20 and the magnification is greater than or equal to ×50000 and less than or equal to ×300000. The average of the thicknesses in whole observation field is determined from the average of the thicknesses in the fields observed. The average of the thicknesses of the whole observation field is defined as the thickness of the insulating coating layer. In the case where there are some parts at which the insulating coating layer is absent (or detached), the thicknesses of the parts are excluded from the measurement range.

Insulating Outer Layer

In the coated pure iron powder and the coated iron alloy powder, an insulating outer layer may be formed on the outer periphery of the insulating coating layer. The material for the insulating outer layers for the coated pure iron powder and the material for the insulating outer layers for the coated iron alloy powder may be the same as each other or different from each other. It is possible to form a single-layer structure composed only of the insulating coating layer in one of the coated pure iron powder and the coated iron alloy powder and a multi-layer (bilayer) structure composed of both of the insulating coating layer and the insulating outer layer in the other. It is also possible to form a multi-layer (bilayer) structure composed of both of an insulating coating layer and an insulating outer layer in each of the coated pure iron powder and the coated iron alloy powder.

Material

The material for the insulating outer layer is preferably a silicic acid compound containing Si and O (oxygen) as the main components. When the insulating outer layer is made from the silicic acid compound, the reduction in the core loss of the dust core can be facilitated. Examples of the silicic acid compound include potassium silicate ($K_2SiO_3$), sodium silicate ($Na_2SiO_3$: also referred to as liquid glass or silicate soda), lithium silicate ($Li_2SiO_3$) and magnesium silicate ($MgSiO_3$). The analysis of the material of the insulating outer layer can be carried out in the same manner as in the above-mentioned method for the analysis of the chemical composition of the insulating coating layer.

Thickness

The thickness of the insulating outer layer is preferably greater than or equal to 10 nm and less than or equal to 100 nm. When the thickness of the insulating outer layers is greater than or equal to 10 nm, it becomes easy to increase the insulation between the particles. When the thickness of the insulating outer layers is less than or equal to 100 nm, it becomes easy to increase the density of the dust core. The thickness of the insulating outer layer is more preferably greater than or equal to 20 nm and less than or equal to 90 nm, particularly preferably greater than or equal to 30 nm and less than or equal to 80 nm. The measurement of the thickness of the insulating outer layer can be carried out in the same manner as in the above-mentioned method for measuring the thickness of the insulating coating layer.

The total thickness of the insulating coating layer and the insulating outer layer is greater than or equal to 40 nm and less than or equal to 300 nm, as long as the thickness of the insulating coating layer and the thickness of the insulating outer layer respectively satisfy the above-mentioned thickness ranges.

Each of the formation of the insulating coating layers and the insulating outer layers on the outer peripheries of the pure iron particles and the iron alloy particles can be carried out by, for example, a chemical conversion treatment. For the formation of the insulating coating layer and the insulating outer layer, any known technique may be employed.

Content of Coated Iron Alloy Powder

The content of the coated iron alloy powder in the raw material powder may be selected appropriately depending on the intended magnetic properties. The content of the coated iron alloy powder in the raw material powder is preferably, for example, greater than or equal to 15% by mass and less than or equal to 40% by mass, relative to 100% by mass of the raw material powder. When the content of the coated iron alloy powder is greater than or equal to 15% by mass, the content of the iron alloy powder having a high electric resistivity can be increased. Therefore, the reduction in an eddy current loss can be facilitated. Furthermore, when the content of the coated iron alloy powder is increased, the reduction in the magnetic coercive force can be facilitated. When the content of the coated iron alloy powder is less than or equal to 40% by mass, the proportion of the iron alloy powder is not excessively too high. Therefore, it becomes easy to prevent the excessive deformation of the coated pure iron powder that is normally deformed easily. Consequently, the prevention of the damage of the insulating coating layers in the coated pure iron powder can be facilitated. Furthermore, the content of the coated pure iron powder that is normally deformed easily can be increased. As a result, the density of the molded article can be increased and consequently the density of the dust core can be increased. The content of the coated iron alloy powder is more preferably greater than or equal to 17% by mass and less than or equal to 38% by mass, particularly preferably greater than or equal to 20% by mass and less than or equal to 35% by mass.

<Metal Soap>

The metal soap can increase lubricity in the molding step. Furthermore, the metal soap can prevent the damage of the insulating coating layers in the coated pure iron powder. More specifically, the metal soap can reduce the stress applied from the iron alloy particles to the pure iron particles in the molding step. An example of the form of the metal soap is a powdery form. The metal soap is substantially burned down in the subsequent heat treatment step.

Type

The type of the metal soap may be selected appropriately depending on the temperature Td of the mold to be employed in the molding step mentioned below in detail. More specifically, the type of the metal soap is such that the difference (Tm−Td) between the melting point Tm of the metal soap and the temperature Td of the mold can satisfy the requirement: "90° C.≤Tm−Td". When a metal soap that satisfies the requirement: "90° C.≤Tm−Td" is used, a dust core having a small core loss can be manufactured. This is presumed to be because the damage of the insulating coating layers in the coated pure iron powder in the molding step can be prevented. As the result of the prevention of the damage of the insulating coating layers, the insulation between the particles can be increased and consequently the eddy current loss can be reduced. By setting the difference Tm−Td to greater than or equal to 90° C., the raw material powder can be compression-molded while avoiding the melting of the metal soap during the molding step. In other words, the raw material powder can be compression-molded under such a condition that the metal soap can keep a certain level of hardness. Due to the action of the metal soap, it becomes easy to reduce the stress applied to the pure iron particles from the iron alloy particles while increasing lubricity during the compression molding. As a result, the damage of the insulating coating layers in the coated pure iron powder can be prevented even if the iron alloy particles deform the pure iron particles upon the compression molding.

The melting point Tm of the metal soap can be selected depending on the temperature Td of the mold, and is preferably, for example, higher than or equal to 120° C., more preferably higher than or equal to 150° C., particularly preferably higher than or equal to 200° C. When the melting point Tm of the metal soap is higher than or equal to 120° C., it becomes possible to increase the density of the molded article while preventing the damage of the insulating coating layers in the coated pure iron powder. Consequently, the density of the dust core can be increased. Because the melting point Tm of the metal soap is high, the difference (Tm−Td) can be increased. Therefore, it becomes possible to impart a certain level of hardness to the metal soap during the compression molding. Consequently, the effect to prevent the damage of the insulating coating layers in the coated pure iron powder can be increased. Furthermore, due to the high melting point Tm of the metal soap, the raw material powder can be compression-molded at a higher temperature Td of the mold. As a result, it becomes possible to facilitate the deformation of the coated pure iron powder and the iron alloy powder. Consequently, it becomes possible to facilitate the increase in the density of the molded article.

Examples of the metal soap include lithium stearate (Tm=220° C.), barium stearate (Tm=228° C.) and sodium stearate (Tm=252° C.). These metal soaps can facilitate the increase in the damage prevention effect of the insulating coating layers in the coated pure iron powder. The type of the metal soap may be selected depending on the temperature Td of the mold, and examples of the metal soap include zinc stearate (Tm=126° C.) and aluminum stearate (Tm=163° C.).

Content

The content of the metal soap is preferably greater than or equal to 0.02% by mass and less than or equal to 0.80% by mass relative to 100% by mass of the raw material powder. When the content of the metal soap is greater than or equal to 0.02% by mass, it becomes easy to achieve the effect to improve the lubricity satisfactorily. As a result, the effect to reduce the stress acting on the pure iron particles can become high. Consequently, the prevention of the damage of the insulating coating layers in the coated pure iron powder can be facilitated. When the content of the metal soap is less than or equal to 0.80% by mass, the content of the metal soap is not excessively too large. Therefore, it becomes possible to prevent the decrease in the content of the metal component in the molded article. The amount of the metal soap to be added is more preferably greater than or equal to 0.03% by mass and less than or equal to 0.70% by mass, particularly preferably greater than or equal to 0.05% by mass and less than or equal to 0.60% by mass.

<Other Components>

In addition to the metal soap, the raw material powder may additionally contain a fatty acid amide, a higher fatty acid amide, an inorganic substance, a fatty acid metal salt or the like as a lubricant. When the raw material powder contains the lubricant, the improvement of the lubricity in the molding step can be facilitated. An example of the fatty acid amide is stearic acid amide. An example of the higher fatty acid amide is ethylenebis(stearic acid amide). Examples of the inorganic substance include boron nitride and graphite. The fatty acid metal salt is composed of a fatty acid and a metal. Examples of the fatty acid include caprylic acid, pelargonic acid, capric acid, undecanoic acid, lauric acid, tridecanoic acid, myristic acid, pentadecanoic acid, palmitic acid, margaric acid, stearic acid, nonadecanoic acid, arachidic acid, heneicosanoic acid, behenic acid, tricosanoic acid, lignoceric acid, pentacosanoic acid, cerotic acid, heptacosanoic acid and montanic acid. Examples of the metal include Mg (magnesium), Ca (calcium), Zn (zinc), Al, Ba (barium), Li (lithium), Sr (strontium), Cd (cadmium), Pb (lead), Na (sodium) and K (potassium). Provided that the fatty acid metal salt is limited to one made from a different material from that for the metal soap. The amount to be added is preferably greater than or equal to 0.05% by mass and less than or equal to 0.70% by mass, more preferably greater than or equal to 0.10% by mass and less than or equal to 0.60% by mass, particularly preferably greater than or equal to 0.20% by mass and less than or equal to 0.50% by mass, relative to 100% by mass of the raw material powder. Like the metal soap, the lubricant is substantially burned down in the subsequent heat treatment step.

[Molding Step]

In the molding step, the raw material powder is subjected to compression molding to manufacture a molded article. The manufacture of the molded article can be carried out by filling the mixed material in a mold that enables the formation of a predetermined shape and then pressurizing the raw material powder in the mold. The shape of the molded article may be selected appropriately depending on the intended shape of a magnetic core for an electromagnetic component.

One example of the mold is a mold equipped with a tubular die having a through-hole, a pair of punches, i.e., an upper punch and a lower punch, capable of being inserted into and detached from the through-hole, and a temperature control machine capable of controlling the temperatures of the upper punch and the lower punch. The upper punch and the lower punch are arranged so as to face each other in the through-hole. In the mold, the upper surface of the lower punch and the inner peripheral surface of the die together form a bottomed cavity (i.e., a molding space). The raw material powder is filled in the cavity. The raw material powder in the cavity is compressed by means of the upper punch and the lower punch to manufacture a columnar molded article. The molded article is removed from the die to obtain the molded article. In the case where it is intended to manufacture a tubular molded article, the mold may be additionally equipped with a columnar core rod. The core rod is inserted into the inside of the upper punch and the lower punch to form an inner peripheral surface of the molded article. In this case, it is preferred that the temperature control machine can also control the temperature of the core rod.

(Molding Pressure)

The molding pressure is preferably greater than or equal to 500 MPa. When the molding pressure is greater than or equal to 500 MPa, it is facilitated to manufacture a molded article having a high density. The molding pressure is more preferably greater than or equal to 800 MPa, preferably greater than or equal to 950 MPa, particularly preferably greater than or equal to 1100 MPa, preferably greater than or equal to 1250 MPa. The upper limit of the molding pressure is preferably, for example, less than or equal to 3000 MPa. When the molding pressure is less than or equal to 3000 MPa, the damage of the insulating coating layers can be prevented. Furthermore, the life of the molding mold cannot be deteriorated so greatly. The molding pressure is more preferably less than or equal to 2500 MPa, particularly preferably less than or equal to 2000 MPa.

(Temperature of Mold)

The temperature Td of the mold is such that the difference (Tm−Td) between the melting point Tm of the metal soap and the temperature Td of the mold can satisfy the requirement: "90° C.≤Tm−Td". When the requirement that the difference (Tm−Td) is greater than or equal to 90° C. is satisfied, it becomes possible to manufacture a dust core having a small core loss as mentioned above. The difference (Tm−Td) is more preferably greater than or equal to 100° C., preferably greater than or equal to 120° C., particularly preferably greater than or equal to 140° C., preferably greater than or equal to 150° C.

The temperature Td of the mold is preferably lower than or equal to 130° C. When the temperature Td of the mold is lower than or equal to 130° C., excess increase in the temperature Td of the mold can be prevented. Therefore, it becomes easy to prevent the excessive deformation of the coated pure iron powder and the iron alloy powder. Consequently, it also becomes easy to prevent the damage of the insulating coating layers in the coated pure iron powder by the action of the metal soap. The temperature Td of the mold is preferably higher than or equal to room temperature (ambient temperature). When the temperature Td of the mold is ambient temperature, the molding can be achieved under a high pressure due to the addition of the metal soap. Therefore, it becomes easy to manufacture a molded article having a high density. The temperature Td of the mold is preferably higher than or equal to 60° C. When the temperature Td of the mold is preferably higher than or equal to 60° C., it becomes easy to deform the coated pure iron powder and the iron alloy powder. Therefore, it becomes easy to manufacture a molded article having a further higher density. The temperature Td of the mold is preferably higher than or equal to 80° C. and lower than or equal to 120° C. The temperature Td of the mold is a preset temperature for the temperature control machine in the mold immediately before the filling of the raw material powder. The preset temperature is equal to the temperature of a raw material powder-contacting part (e.g., the inner peripheral surface of the die, a pressing face of each of the upper punch and the lower punch) in the mold immediately before the filling of the raw material powder. Therefore, the temperature of the raw material powder-contacting part may be set to the temperature Td of the mold. For the measurement of the temperature of the raw material powder-contacting part, a commercially available non-contact-type thermometer can be used.

At the raw material powder-contacting part in the mold, a lubricant may be applied. The lubricant applied onto the contacting part in the mold can facilitate the reduction in friction against the powders. Furthermore, it becomes easy to manufacture a molded article having a high density. Examples of the material for the lubricant include those materials which are mentioned in the section "other components" in the raw material powder mentioned above.

[Heat Treatment Step]

In the heat treatment step, the molded article is subjected to a heat treatment to eliminate distortions introduced into the coated pure iron powder and the iron alloy powder in the molding step.

The heat treatment atmosphere to be employed is one having an oxygen concentration of greater than 0 ppm by volume and less than or equal to 10000 ppm by volume, more preferably greater than or equal to 100 ppm by volume and less than or equal to 5000 ppm by volume, particular preferably greater than or equal to 200 ppm by volume and less than or equal to 1000 ppm by volume. The heat treatment temperature is preferably higher than or equal to 400° C. and lower than or equal to 1000° C. The heat treatment temperature is more preferably higher than or equal to 450° C., particularly preferably higher than or equal to 500° C. The heat treatment temperature is more preferably lower than or equal to 900° C., particularly preferably lower than or equal to 800° C. The retention time is preferably longer than or equal to 10 minutes and shorter than or equal to 60 minutes, more preferably longer than or equal to 10 minutes and shorter than or equal to 30 minutes, particularly preferably longer than or equal to 10 minutes and shorter than or equal to 15 minutes. When the molded article is heat-treated under these conditions, the distortions in the coated pure iron powder and the iron alloy powder can be eliminated satisfactorily. As a result, the hysteresis loss can be reduced. Accordingly, it becomes easy to manufacture a dust core having a small core loss.

[Use Applications]

The method for manufacturing a dust core according to the embodiment can be used suitably in the manufacture of a dust core that can be provided in various electromagnetic components (e.g., a reactor, a transformer, a motor, a choke coil, an antenna, a fuel injector, an ignition coil). The raw material powder (raw material powder for a dust core) according to the embodiment can be used suitably as a raw material for a dust core.

[Functional Effect]

According to the method for manufacturing a dust core according to the embodiment, when "(the melting point Tm of the metal soap)−(the temperature Td of the mold)" is adjusted to greater than or equal to 90° C., it becomes possible to compression-mold the raw material powder while preventing the melting of the metal soap and keeping a certain level of hardness of the metal soap in the molding step. Due to the action of the metal soap, it becomes easy to reduce the stress applied to the pure iron particles from the iron alloy particles while increasing lubricity during the compression molding. As a result, the damage of the insulating coating layers in the coated pure iron powder can be prevented even if the iron alloy particles deform the pure iron particles upon the compression molding. As the result of the prevention of the damage of the insulating coating layers, the insulation between the particles can be improved. As the result of this improvement of the insulation, the eddy current loss can be reduced. Accordingly, it becomes possible to manufacture a dust core having a small iron loss (core loss).

Test Example 1

Dust core samples were manufactured, and the density and magnetic properties of each of the samples were evaluated.

[Sample Nos. 1 to 11]

Dust cores of sample Nos. 1 to 11 were manufactured in the same manner as in the above-mentioned method for manufacturing a dust core, i.e., by the procedure including a preparation step, a molding step and a heat treatment step in this order.

[Preparation Step]

Raw material powders each containing a coated pure iron powder, a coated iron alloy powder and a metal soap were prepared. Each of the raw material powders for sample Nos. 1 to 4 and 6 to 11 excluding sample No. 5 additionally contained a lubricant other than a metal soap, as mentioned below. Coated pure iron powders were prepared, which were composed of: a plurality of pure iron particles, insulating coating layers respectively covering the outer peripheries of the pure iron particles, and insulating outer layers respectively covering the outer peripheries of the insulating coating layers. The pure iron particles were composed of pure iron (purity: greater than or equal to 99% by mass; with the remainder made up by unavoidable impurities). The average particle diameter (D50) of the pure iron particles was 55 μm. Coated iron alloy powders were prepared, which were composed of: a plurality of iron alloy particles composed of an iron alloy, insulating coating layers respectively covering the outer peripheries of the iron alloy particles, and insulating outer layers respectively covering the outer peripheries of the insulating coating layers. The average particle diameter (D50) of the iron alloy particles was 60 μm.

As the iron alloy powders for the samples, iron alloy powders were prepared, each of which had a chemical composition represented by any one of type symbols a to c and a specified Vickers hardness, as shown in Table 1. The type symbols a to c shown in the column for the chemical compositions in Table 1 are as mentioned below. Each of the Vickers hardness values shown in Table 1 was a value determined by embedding the iron alloy particles in a resin, then grinding the resin so as to expose the iron alloy particles constituting the iron alloy powder, and then measuring the exposed iron alloy particles (an average of values measured with respect to n=10).

Type symbol a: 9.5% by mass of Si, 5.5% by mass of Al, remainder made up by Fe and unavoidable impurities.

Type symbol by mass: 6.5% by mass of Si, remainder made up by Fe and unavoidable impurities.

Type symbol c: 3.5% by mass of Si, remainder made up by Fe and unavoidable impurities.

An insulating coating layer composed of iron phosphate was formed on the outer periphery of each of the pure iron particles and the iron alloy particles, and an insulating outer layer containing Si—O as the main component was formed on the outer periphery of the insulating coating layer. The thickness of each of the insulating coating layer and the insulating outer layer was about 100 nm. The formation of the insulating coating layer was carried out by a bonderizing treatment. The formation of the insulating outer layer was carried out by a chemical conversion treatment.

As the metal soaps in the raw material powders of the samples, Li-st (lithium stearate), Na-st (sodium stearate) and Ba-st (barium stearate) were used, as shown in Table 1. The melting points Tm of the metal soaps are shown in Table 1. Each of the raw material powders for sample Nos. 1 to 4 and 6 to 11 excluding sample No. 5 additionally contained EBS (ethylenebis(stearic acid amide) as a lubricant other than the metal soap.

The contents of the coated iron alloy powder, the metal soap and the lubricant other than the metal soap in the raw material powder for each of the samples were those amounts shown in Table 1 relative to 100% by mass of the raw material powder, and the remainder in the raw material powder for each of the samples was the coated pure iron powder.

[Molding Step]

Each of the raw material powders was filled in a mold, and was then compression-molded to manufacture a ring-shaped (outer diameter: 34 mm, inner diameter: 20 mm, thickness: 5 mm) molded article. As the mold, a mold equipped with a die, an upper punch and a lower punch, a core rod and a temperature control machine was used. The die has a cylindrical through-hole. Each of the upper punch and the lower punch was formed in a cylindrical shape having a ring-shaped pressing face, and was inserted into and detached from the through-hole in the die. The core rod was formed in a cylindrical shape that formed the inner peripheral surface of the molded article, and was inserted into and detached from the inside of each of the upper punch and the lower punch. The temperature control machine controlled the temperature of the mold. The compression molding was carried out under the atmosphere at a mold temperature Td shown in Table 1 under a molding pressure of 1500 MPa. The temperature Td of the mold was a temperature measured at a raw material powder-contacting part (e.g., the inner peripheral surface of the die, a pressing face of each of the upper punch and the lower punch) in the die using a thermocouple immediately before the filling of the raw material powder.

[Heat Treatment Step]

The molded article was heat-treated to manufacture a dust core. As for the conditions for the heat treatment, the heat treatment was carried out under a nitrogen atmosphere at a temperature of 700° C. with a retention time of 15 minutes.

[Samples Nos. 101 to 111]

Dust cores of sample Nos. 101 to 111 were manufactured in the same manner as in the manufacture of the below-mentioned samples mentioned below, except that the points mentioned below were different, as shown in Table 1.

Sample No. 101 was different from sample No. 1 in the matter that no metal soap was contained in sample No. 101.

Sample No. 102 was different from sample No. 1 in the matter that the metal soap used in sample No. 102 was Zn-st (zinc stearate).

Sample No. 103 was different from sample No. 1 in the matter that the metal soap used in sample No. 103 was Al-st (aluminum stearate).

Sample No. 104 was different from sample No. 3 in the matter that the temperature Td of the mold employed for sample No. 104 was higher than that employed for sample No. 3.

Sample No. 105 was different from sample No. 8 in the matter that no metal soap was contained in sample No. 105.

Sample No. 106 was different from sample No. 9 in the matter that no metal soap was contained in sample No. 106.

Sample No. 107 was different from sample No. 8 in the matter that the content of the coated iron alloy powder in sample No. 107 was smaller than that in sample No. 8 and no metal soap was contained in sample No. 107.

Sample No. 108 was different from sample No. 9 in the matter that the content of the coated iron alloy powder in sample No. 108 was larger than that in sample No. 9 and no metal soap was contained in sample No. 108.

Sample No. 109 was different from sample No. 10 in the matter that no metal soap was contained in sample No. 109.

Sample No. 110 was different from sample No. 11 in the matter that no metal soap was contained in sample No. 110.

Sample No. 111 was different from sample No. 1 in the matter that the iron alloy in the coated iron alloy powder in sample No. 111 had a chemical composition represented by type symbol d mentioned below, the Vickers hardness of sample No. 111 was lower than that in sample No. 1 and no metal soap was contained in sample No. 111.

Type symbol d: 3.0% by mass of Si, remainder made up by Fe and unavoidable impurities.

[Density]

The density (g/cm$^3$) of a dust core of each of the samples was measured. The density was measured by employing an Archimedes method. The results are shown in Table 1.

[Magnetic Properties]

The magnetic properties of a dust core of each of the samples was measured in the following manner. A copper wire was wound around a ring-shaped dust core of each of the samples to manufacture a member for measurement (a primary winding coil: 300 turns, a secondary winding coil: 20 turns). An iron loss W1/20 k (a hysteresis loss+an eddy current loss) at an excited magnetic flux density Bm of 0.1 T and a measuring frequency of 20 kHz was determined using the member for measurement and an AC-BH curve tracer (Riken Denshi Co., Ltd., BHU-60). The results of the iron losses W1/20 k and the results of the eddy current losses W1e/20 k are shown together in Table 1.

TABLE 1

| | Iron alloy powder | | | Metal soap | | | Lubricant | | | Mold | | Dust core | | |
|---|---|---|---|---|---|---|---|---|---|---|---|---|---|---|
| Sample No. | Chemical composition Type symbol | Vickers hardness (HV) | Content (% by mass) | Type | Melting point Tm (° C.) | Content (% by mass) | Type | Melting point (° C.) | Content (% by mass) | Temperature Td (° C.) | Tm − Td (° C.) | Density (g/cm$^3$) | Iron loss W1/20 k (kW/m$^3$) | Eddy current loss W1e/20 k (kW/m$^3$) |
| 1 | a | 500 | 30 | Li-st | 220 | 0.05 | EBS | 146 | 0.4 | 80 | 140 | 7.09 | 195 | 49 |
| 2 | a | 500 | 30 | Li-st | 220 | 0.05 | EBS | 146 | 0.4 | 25 | 195 | 7.05 | 201 | 48 |
| 3 | a | 500 | 30 | Li-st | 220 | 0.05 | EBS | 146 | 0.4 | 120 | 100 | 7.11 | 194 | 51 |
| 4 | a | 500 | 30 | Li-st | 220 | 0.02 | EBS | 146 | 0.4 | 80 | 140 | 7.11 | 190 | 48 |
| 5 | a | 500 | 30 | Li-st | 220 | 0.02 | — | — | — | 80 | 140 | 7.14 | 185 | 48 |
| 6 | a | 500 | 30 | Na-st | 252 | 0.05 | EBS | 146 | 0.4 | 80 | 172 | 7.08 | 196 | 48 |
| 7 | a | 500 | 30 | Ba-st | 228 | 0.05 | EBS | 146 | 0.4 | 80 | 148 | 7.09 | 195 | 49 |
| 8 | a | 500 | 15 | Li-st | 220 | 0.05 | EBS | 146 | 0.4 | 80 | 140 | 7.28 | 252 | 79 |
| 9 | a | 500 | 40 | Li-st | 220 | 0.05 | EBS | 146 | 0.4 | 80 | 140 | 6.95 | 174 | 31 |
| 10 | b | 420 | 30 | Li-st | 220 | 0.05 | EBS | 146 | 0.4 | 80 | 140 | 7.36 | 230 | 53 |
| 11 | c | 210 | 30 | Li-st | 220 | 0.05 | EBS | 146 | 0.4 | 80 | 140 | 7.45 | 260 | 58 |
| 101 | a | 500 | 30 | — | — | — | EBS | 146 | 0.4 | 80 | — | 7.09 | 212 | 60 |
| 102 | a | 500 | 30 | Zn-st | 126 | 0.05 | EBS | 146 | 0.4 | 80 | 46 | 7.10 | 211 | 60 |
| 103 | a | 500 | 30 | Al-st | 163 | 0.05 | EBS | 146 | 0.4 | 80 | 83 | 7.09 | 212 | 59 |
| 104 | a | 500 | 30 | Li-st | 220 | 0.05 | EBS | 146 | 0.4 | 140 | 80 | 7.13 | 213 | 61 |
| 105 | a | 500 | 15 | — | — | — | EBS | 146 | 0.4 | 80 | — | 7.29 | 265 | 91 |
| 106 | a | 500 | 40 | — | — | — | EBS | 146 | 0.4 | 80 | — | 6.98 | 183 | 40 |
| 107 | a | 500 | 10 | — | — | — | EBS | 146 | 0.4 | 80 | — | 7.38 | 278 | 97 |
| 108 | a | 500 | 45 | — | — | — | EBS | 146 | 0.4 | 80 | — | 6.84 | 175 | 48 |
| 109 | b | 420 | 30 | — | — | — | EBS | 146 | 0.4 | 80 | — | 7.36 | 243 | 67 |

TABLE 1-continued

| | Iron alloy powder | | | | | | | | | | | Dust core | | |
|---|---|---|---|---|---|---|---|---|---|---|---|---|---|---|
| | Chemical | | | Metal soap | | | Lubricant | | | Mold | | | | Eddy |
| Sample No. | composition Type symbol | Vickers hardness (HV) | Content (% by mass) | Type | Melting point Tm (° C.) | Content (% by mass) | Type | Melting point (° C.) | Content (% by mass) | Temperature Td (° C.) | Tm − Td (° C.) | Density (g/cm³) | Iron loss W1/20 k (kW/m³) | current loss W1e/20 k (kW/m³) |
| 110 | c | 210 | 30 | — | — | — | EBS | 146 | 0.4 | 80 | — | 7.46 | 270 | 72 |
| 111 | d | 170 | 30 | — | — | — | EBS | 146 | 0.4 | 80 | — | 7.49 | 288 | 60 |

As shown in Table 1, sample Nos. 1 to 11, in each of which the requirement that the difference (Tm−Td) between the melting point Tm of the metal soap and the temperature Td of the mold was greater than or equal to 90° C. was satisfied, had small eddy current losses and small iron losses (low core losses). Furthermore, sample Nos. 1 to 11 had high densities.

When the comparison was made between sample Nos. 1 to 7 and sample Nos. 101 to 104, between sample No. 8 and sample No. 105, between sample No. 9 and sample No. 106, between sample No. 10 and sample No. 109, and between sample No. 11 and sample No. 110, it was demonstrated that the eddy current loss was reduced by satisfying the requirement that the above-mentioned difference (Tm−Td) was greater than or equal to 90° C. Namely, it is demonstrated that the iron loss can be reduced. Comparison is made between sample No. 8 and sample No. 107. Sample No. 8 contained the coated iron alloy powder in a larger amount than that in sample No. 107. Therefore, in sample No. 8, the electric resistivity was more likely to be increased. However, sample No. 8 was likely to deform the pure iron particles to increase the eddy current loss. Nevertheless, it was demonstrated that, in sample No. 8, the eddy current loss was reduced to a smaller value than that in sample No. 107. Namely, it is demonstrated that the iron loss can be reduced. Comparison was made between sample No. 9 and sample No. 108. Sample No. 9 contained the coated iron alloy powder in a smaller amount than that in sample No. 108. Therefore, in sample No. 9, the pure iron particles were less likely to be deformed to reduce the eddy current loss. However, in sample No. 9, the electric resistivity was less likely to be increased. Nevertheless, it was demonstrated that, in sample No. 9, the eddy current loss was reduced. Namely, it is demonstrated that the iron loss can be reduced. Comparison was made between sample Nos. 1 to 7 and sample No. 111. In each of sample Nos. 1 to 7, the Vickers hardness of the iron alloy particles was higher than that in sample No. 111. Therefore, in each of sample Nos. 1 to 7, the pure iron particles were more likely to be deformed to increase the eddy current loss. Nevertheless, it was demonstrated that, in each of sample Nos. 1 to 7, the eddy current loss was reduced to a smaller value than that in sample No. 111. Namely, it is demonstrated that the iron loss can be reduced.

From the results of sample Nos. 1 to 3, it was demonstrated that the eddy current loss tended to become smaller with the increase in the above-mentioned difference (Tm−Td). From the results of sample Nos. 1, 4 and 5, it was demonstrated that the metal soap was effective for the reduction in the eddy current loss even when the metal soap was added in a small amount. Furthermore, it was also demonstrated that the metal soap was effective for the reduction in the eddy current loss even when any lubricant other than the metal soap was not contained. From the results of sample Nos. 1, 6 and 7, it was demonstrated that, when the requirement: "90° C.≤the difference (Tm−Td)" was satisfied, the eddy current loss was reduced even when the Na-st and Ba-st, as well as Li-st, were used as metal soaps. Accordingly, in sample Nos. 102 and 103 in which Zn-st and Al-St were used, although the eddy current loss was not reduced, it is expected that the eddy current loss would be reduced by satisfying the requirement: "90° C.≤the difference (Tm−Td)" even when the metal soap used was Zn-st or Al-St. From the results of sample Nos. 1, 8 and 9, it was demonstrated that the increase in the electric resistivity was more likely to be increased with the increase in the content of the coated iron alloy powder. However, the coated pure iron particles were more likely to be deformed and the eddy current loss was more likely to be increased with the increase in the amount of the coated iron alloy powder. Nevertheless, it was demonstrated that the effect to reduce the eddy current loss was high. From the results of sample Nos. 1, 10 and 11, it was demonstrated that the pure iron particles were more likely to be deformed and the eddy current loss was more likely to be increased with the increase in the Vickers hardness of the iron alloy particles. Nevertheless, it was demonstrated the eddy current loss was reduced.

It is to be understood that the present invention is not limited to the disclosed exemplary embodiments but rather by the terms of appended claims, and is intended to include any modifications within the scope and meaning equivalent to the terms of claims.

The invention claimed is:

1. A method for manufacturing a dust core, comprising:

a step of preparing a raw material powder including a coated pure iron powder composed of a plurality of pure iron particles each having an insulating coating layer, a coated iron alloy powder composed of a plurality of iron alloy particles each having an insulating coating layer, a metal soap, and a lubricant, such that at least one of the coated pure iron powder or the coated iron alloy powder includes a multi-layer structure further comprising an insulating outer layer containing a metal-silicate compound;

a step of manufacturing a molded article by performing a compression molding of the raw material powder filled in a mold; and a step of performing a heat treatment of the molded article to eliminate distortions in the coated pure iron powder and the coated iron alloy powder, wherein a difference Tm−Td between a melting point Tm of the metal soap and a temperature Td of the mold in the step of manufacturing the molded article is greater than or equal to 90° C., the average particle diameter of the pure iron particles is greater than or equal to 50 μm and less than or equal to 400 μm, and the lubricant is at least one selected from the group consisting of a fatty acid amide, ethylenebis(stearic acid amide), and an inorganic substance.

2. The method for manufacturing a dust core according to claim 1, wherein the melting point Tm of the metal soap is higher than or equal to 200° C.

3. The method for manufacturing a dust core according to claim 1, wherein the temperature Td of the mold is lower than or equal to 130° C.

4. The method for manufacturing a dust core according to claim 1, wherein a Vickers hardness of the iron alloy particles is greater than or equal to 200 HV.

5. The method for manufacturing a dust core according to claim 1, wherein a Vickers hardness of the iron alloy particles is greater than or equal to 200 HV, the melting point Tm of the metal soap is higher than or equal to 200° C., and the temperature Td of the mold is lower than or equal to 130° C.

6. The method for manufacturing a dust core according to claim 1, wherein a content of the coated iron alloy powder in the raw material powder is greater than or equal to 15% by mass and less than or equal to 40% by mass.

7. The method for manufacturing a dust core according to claim 1, wherein a content of the metal soap in the raw material powder is greater than or equal to 0.02% by mass and less than or equal to 0.80% by mass.

8. The method for manufacturing a dust core according to claim 1, wherein each of the iron alloy particles contains at least one additive element selected from Si and Al.

9. The method for manufacturing a dust core according to claim 1, wherein a thickness of each of the insulating coating layer in the coated pure iron powder and the insulating coating layer in the coated iron alloy powder is greater than or equal to 30 nm and less than or equal to 300 nm.

10. The method for manufacturing a dust core according to claim 1, wherein, the step of performing a heat treatment of the molded article is carried out under an atmosphere having an oxygen concentration of greater than 0 ppm by volume and less than or equal to 10000 ppm by volume at a temperature of higher than or equal to 400° C. and lower than or equal to 1000° C. and with a retention time of longer than or equal to 10 minutes and shorter than or equal to 60 minutes.

11. The method for manufacturing a dust core according to claim 1, wherein the average particle diameter of the iron alloy particles is greater than or equal to 50 μm and less than or equal to 400 μm.

12. A raw material powder for a dust core, comprising:

a coated pure iron powder composed of a plurality of pure iron particles each having an insulating coating layer;

a coated iron alloy powder composed of a plurality of iron alloy particles each having an insulating coating layer;

a metal soap which has a melting point Tm of higher than or equal to 200° C., and a lubricant, wherein a Vickers hardness of the iron alloy particles is greater than or equal to 200 HV, a content of the coated iron alloy powder is greater than or equal to 15% by mass and less than or equal to 40% by mass, a content of the metal soap is greater than or equal to 0.02% by mass and less than or equal to 0.80% by mass, the average particle diameter of the pure iron particles is greater than or equal to 50 μm and less than or equal to 400 μm, and the lubricant is at least one selected from the group consisting of a fatty acid amide, ethylenebis(stearic acid amide), and an inorganic substance, wherein at least one of the coated pure iron powder or the coated iron alloy powder includes a multi-layer structure further comprising an insulating outer layer containing a metal-silicate compound.

13. The raw material powder for a dust core according to claim 12, wherein the average particle diameter of the iron alloy particles is greater than or equal to 50 μm and less than or equal to 400 μm.

* * * * *